United States Patent [19]

Park

[11] Patent Number: 4,734,075

[45] Date of Patent: Mar. 29, 1988

[54] EDUCATIONAL PLUSH TOY

[76] Inventor: Doo S. Park, 12-408 Hanshin-Gongyoung, Apt. Group 1, Shinbanpo, Kang-Namgu, Seoul, Rep. of Korea

[21] Appl. No.: 872,222

[22] Filed: Jun. 9, 1986

[51] Int. Cl.[4] ..... A63H 3/14

[52] U.S. Cl. ..... 446/321; 446/327; 446/369

[58] Field of Search ..... 446/321, 327, 369

[56] References Cited

U.S. PATENT DOCUMENTS

| | | | |
|---|---|---|---|
| 1,307,218 | 6/1919 | Spencer | 446/369 |
| 1,518,576 | 12/1924 | Edwards | 446/327 |
| 1,552,348 | 9/1925 | Rosenthal | 446/369 X |
| 2,274,303 | 2/1942 | Ornstein | 446/369 X |
| 3,820,276 | 6/1974 | Goldfarb et al. | 446/327 |

FOREIGN PATENT DOCUMENTS

| | | | |
|---|---|---|---|
| 1268636 | 4/1902 | France | 446/369 |

*Primary Examiner*—Kenneth J. Dorner
*Assistant Examiner*—Peter R. Brown
*Attorney, Agent, or Firm*—Handal & Morofsky

[57] ABSTRACT

A plush toy, comprising a costume which is a sculptural representation of a first item is disclosed. The costume comprises a hollow base portion, a head portion attached to the hollow base portion and a snout portion attached to the head portion. A second sculptural element which may be a human figure is adapted to fit into hollows defined by the costume. Finally, a pillow is attached to the costume between the hollow head portion and the hollow base portion and is freely movable to fill either hollow.

14 Claims, 12 Drawing Figures

EDUCATIONAL PLUSH TOY

TECHNICAL FIELD

The invention relates to a plush toy doll capable of manipulation into a plurality of forms through a variety of operations calculated to stimulate the ability of a child to deal with abstract spatial relationships.

BACKGROUND ART

Over the years significant effort has been devoted to the design of various educational toys. Such toys include letter building blocks, books with audio-visual cues, and even more complicated systems involving such things as audio-visual cues and computer controlled learning routines.

The importance of such devices cannot be overemphasized in view of the overwhelming evidence that educational development of children, throughout their entire lives, has been shown to be greatly advanced by the earliest possible teaching of various concepts. In the society which we have today, where technology is so important and success is, often, tied to an ability to deal with technology, the appreciation of such physical phenomena as spatial relationships is of great importance.

However, while such toys as building blocks, play logs, and the like do teach certain limited spatial relationships, many aspects of educational development are neglected by the same. For example such toys fail to clarify the concepts of full and empty space, the concept of surfaces divorced from volume, plastic manipulation of one form into another, together with stimulated ideas that would flow from the consideration of such concepts by the child.

DISCLOSURE OF INVENTION

The invention, as claimed, is intended to provide a remedy. It solves the problem of how to teach certain specific advanced spatial concepts to a child with a device which is attention drawing, inexpensive and durable.

In accordance with the preferred embodiment, the above objects are achieved by providing a multi-element plush toy. The first of the elements is a simple doll in the form of a first creature. In accordance with the preferred embodiment the first creature is a small child. The second element is in the form of a covering for the first element, a head, including a partially hollowed portion and a filled portion and a hollowed body portion capable of receiving the first element and an appendage secured between the head portion and the body portion and easily acts as a stuffing for either the insides of the head or body.

Manipulation of the various parts, including, stuffing, emptying, turning inside out and so forth result in transforming the plush toy into various different and as well as a plurality of simultaneous forms.

BRIEF DESCRIPTION OF DRAWINGS

One way of carrying out the invention is described in detail below with reference to drawings which illustrate only one specific embodiment, in which.

BEST MODE OF CARRYING OUT THE INVENTION

Figure 1:
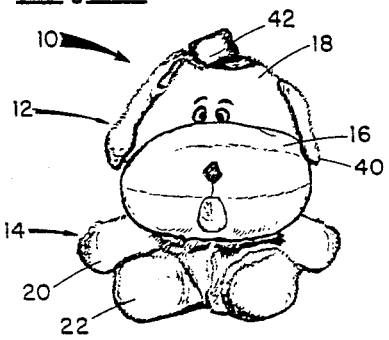
FIG. 1 is a view of the unmanipulated toy.
Figure 2:
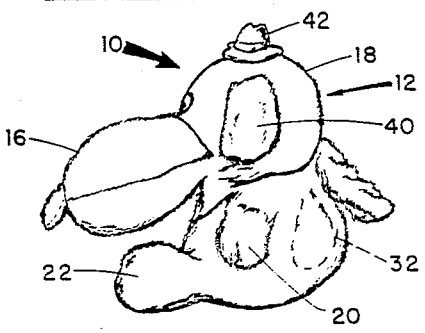
FIG. 2 is a side view of the toy in FIG. 1.

A plush toy 10 constructed in accordance with the present invention is illustrated in FIGS. 1 and 2. Generally the toy may comprise a cartoon character or other item which may be either human, animal or a combination human-animal figure. In accordance with the illustrated embodiment, toy 10 includes a head portion 12 and a body portion 14. Head portion 12 is divided into a snout subportion 16 and a cranium subportion 18.

Figure 3:
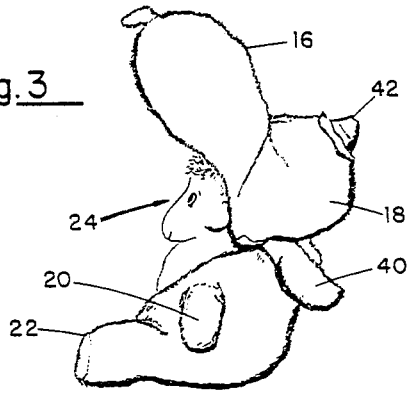
FIG. 3 is a view of the toy after a first step of manipulation.
Figure 4:
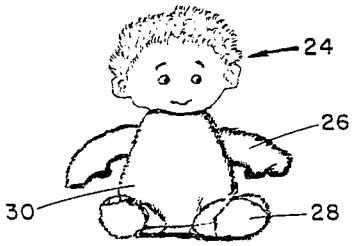
FIG. 4 is a view of the inside element of the toy.
Figure 7:
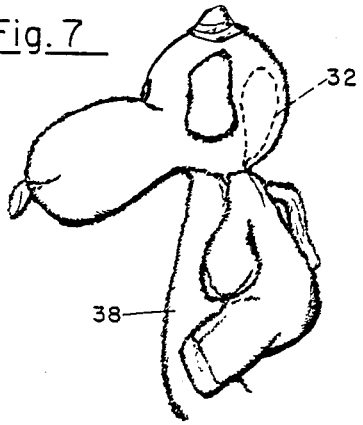
FIG. 7 shows use of the toy as a hand puppet.

Cranium subportion 18 and a body portion 14 both define hollow chambers which together with hollow chambers defined by hands 20 and feet 22 together receive therein a baby doll figure 24. The head of doll 24 may be exposed by lifting snout 16 as shown in FIG. 3. This lifting operation defines the second figure made by the plush toy, namley, a child wearing an animal costume. The hands 26 and feet 28 of the doll 24, as illustrated in FIG. 7 go into the hollow hands 20 and feet 22 of the animal costume. See FIG. 4.

Figure 5:
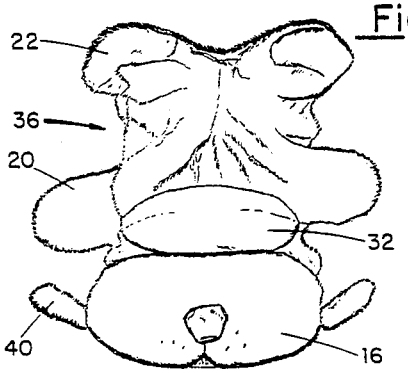
FIG. 5 is a rear view of the outside covering of the present invention exposing the stuffing member.
Figure 6:
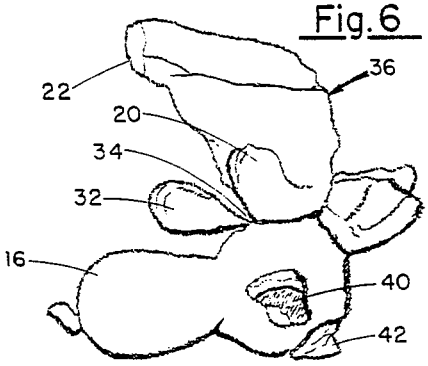
FIG. 6 is a side view of the toy as illustrated in FIG. 5.

The seat 30 of the doll 24 is designed to be relatively small allowing for the insertion of a pillow 32 into the body portion 14 as illustrated in phantom lines in FIG. 2. This pillow is secured at its upper end 34 to the animal costume 36 illustrated in FIGS. 5 and 6. Here the actual attachment of pillow 32 is shown. Pillow 32 is so sewn to animal costume 36 as to be insertable into either cranium subportion 18 or body portion 14. While doll 24 is inserted into the cranium subportion 18, pillow 32 is positioned within body portion 14.

It is also possible to use the toy as a hand puppet as illustrated in FIG. 7. Here pillow 32 is inserted into cranium subportion 18 in order to give the cranium subportion 18 a full and proper appearance even when it is filled only with the small hand of a child who has positioned his arm 38 as illustrated in FIG. 7.

It is noted that the concepts of stuffing, unstuffing and shifting volume and fillers is aptly taught to the child by the above structures and the manipulations described above.

Figure 8:
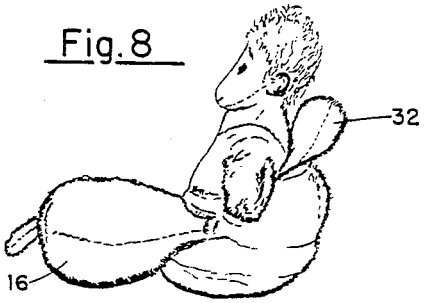
FIG. 8 shows the toy after manipulation has been completed.
Figure 9:
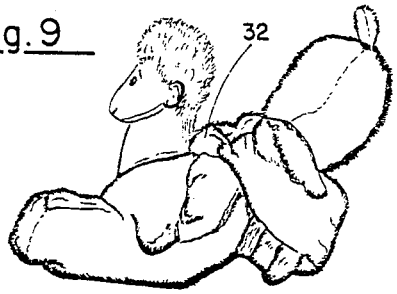
FIG. 9 is a view of the toy upon further manipulation in the manner begun in FIG. 3.
Figure 10:
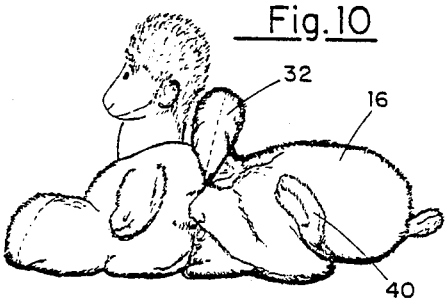
FIG. 10 is a view of a yet futher advanced point in the manipulation in FIGS. 1–3.
Figure 11:
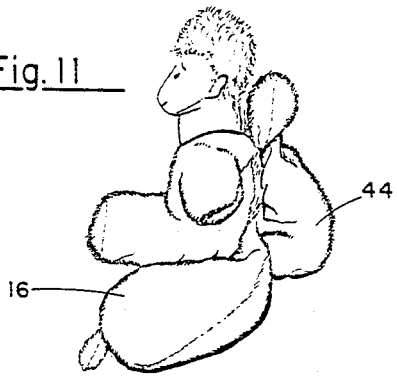
FIGS. 11–12 show the final three steps in the manipulation.
Figure 12:
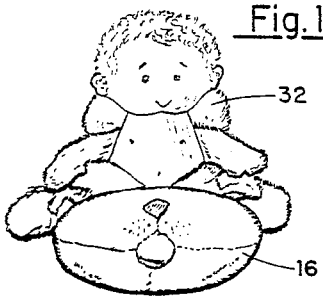

The plush toy of the present invention may also be radically converted from the child wearing an animal costume in FIG. 3 to a child in a boat in illustrated in FIG. 8. In order to accomplish this transformation the head of the animal costume 36 is pulled further from the position illustrated in FIG. 3 to the position in FIG. 9. This exposes pillow 32 to view. Continuing movement results in complete exposure and removal of pillow 32 from body portion 14, as illustrated in FIG. 10. After this is done cranium subportion 18 is turned inside out thus resulting in the insertion of ears 40 and hat 42 into the inside-out cranium subportion 44 as illustrated in FIG. 11. Finally, the seat 30 and feet 22 of costume 36 and body portion 14 of costume 36 are forcably fitted into the remaining volume in inside-out cranium subportion 44. This results in the appearance of a doll in a boat as illustrated in FIG. 8. If desired, the hands 26 of the doll may be removed from the hands 20 of costume 36 to provide an interesting effect as illustrated in the front view of FIG. 12.

While an illustrative embodiment of the invention has been described, it is, or course, understood that various modifications will be obvious to those of ordinary skill in the art.

Such modifications are within the spirit and scope of the invention which is limited and defined only by the appended claims.

What is claimed is:

1. A plush toy, comprising:

(a) costume means for being a sculputural representation of a first item, said costume means being defined by:

i. a hollow base portion;

ii. a hollow head portion attached to said base portion; and iii. a filled snout portion attached to said head portion;

(b) a second sculptural element comprising a solid manipulable figure of a second item adapted to fill the hollow portions of said costume means; and (c) stuffing means attached to said costume means and insertable in said base portion or said head portion.

2. A plush toy as in claim 1 wherein said stuffing means together with the lower half of said second sculptural element fills said hollow base portion.

3. A plush toy as in claim 1 wherein said costume means is an animal costume and said second sculptural element is a human baby doll..

4. A plush toy as in claim 1 wherein said stuffing means is a pillow hindgely attached along an elongated transverse seam which corresponds to the joint between the base of said hollow head portion and the top of said hollow base portion.

5. A plush toy, comprising:

(a) costume means for being a sculptural representation of a first item, said costume means being defined by:

i. a hollow base portion;

ii. a hollow head portion attached to said base portion; and iii. a filled snout portion attached to said head portion;

(b) a second sculptural element comprising a solid manipulable figure of a person having a head, body, hands and legs adapted to fill the hollow portions of said costume means; and (c) a unitary stuffing member attached to said costume means and insertable in said base portion or said head portion.

6. A plush toy as in claim 5 wherein said stuffing member together with the lower half of said second sculptural element fills said hollow base portion.

7. A plush toy as in claim 5 wherein said costume means is an animal costume and said figure of a person is a human baby doll.

8. A plush toy as in claim 5 wherein said stuffing member is a pillow hindgely attached along an elognated transverse seam which corresponds to the joint between the base of said hollow head portion and the top of said hollow base portion.

9. A plush toy as in claim 8 wherein said pillow has a rounded shape opposite said seam.

10. A plush toy, comprising:

(a) costume means for being a sculptural representation of a first item, said costume means being defined by:

i. a hollow base portion; and ii. a hollow head portion attached to said base portion;

(b) a second sculptural element comprising a solid figure of a second item adapted to fill the hollow portions of said costume means; and (c) a stuffing member attached to said costume means at the junction between card base portion and said head portion and insertable in said base portion or said head portion, the volume of said stuffing member being substantially great enough to fill said hollow head portion when the hand of a child is inserted therein to use said toy as a puppet.

11. A plush toy as in claim 10, wherein said costume means further comprises a filled snout portion attached to said head portion.

12. A plush toy as in claim 10 wherein said stuffing member together with lower half of said second sculptural element fills said hollow base portion.

13. A plush toy as in claim 10 wherein said costume means is an animal costume and said second sculptural element is a human body doll.

14. A plush toy as in claim 10 wherein said pillow means is hindgely attached along an elongated transverse seam which corresponds to the joint between the base of said hollow head portion and the top of said hollow base portion.

* * * * *